US005477733A

United States Patent [19]

Duarte

[11] Patent Number: 5,477,733

[45] Date of Patent: Dec. 26, 1995

[54] PROJECTILE RECOVERY DEVICE

[75] Inventor: George M. Duarte, Providence, R.I.

[73] Assignee: The United States of America as represented by the Secretary of the Navy, Washington, D.C.

[21] Appl. No.: 387,001

[22] Filed: Feb. 9, 1995

[51] Int. Cl.[6] ..... F41A 31/00; F42B 35/00

[52] U.S. Cl. ..... 73/167

[58] Field of Search ..... 73/167; 273/404, 273/410

[56] References Cited

U.S. PATENT DOCUMENTS

| | | | |
|---|---|---|---|
| 2,498,045 | 2/1950 | Looney et al. | 73/167 |
| 2,813,422 | 11/1957 | Schuessler | 73/167 |
| 3,678,745 | 7/1972 | Teng | 73/167 |
| 3,718,041 | 2/1973 | Jones et al. | 73/167 |
| 3,940,981 | 3/1976 | Covey et al. | 73/167 |
| 4,002,064 | 1/1977 | Curchack | 73/167 |
| 4,300,389 | 11/1981 | Tevelow | 73/167 |
| 4,345,460 | 8/1982 | Curchack et al. | 73/167 |
| 5,125,343 | 6/1992 | Domen et al. | 73/167 X |

*Primary Examiner*—William A. Cuchlinski, Jr.
*Assistant Examiner*—Willie Morris Worth
*Attorney, Agent, or Firm*—Michael J. McGowan; Prithvi C. Lall; Michael F. Oglo

[57] ABSTRACT

The device includes a rigid vessel that supports a frustoconical membrane at the projectile entry end and at a downstream end. The volume defined between the vessel side walls and the membrane is filled with a fluid under pressure. The pressure is adjusted to accommodate a particular projectile size and weight so that the projectile is decelarated over a distance that is chosen to minimize inertial loads on the projectile.

9 Claims, 1 Drawing Sheet

PROJECTILE RECOVERY DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to apparatus for decelerating projectiles in a fluid medium, and more specifically to a device for effectively decelerating projectiles of various weights and sizes with a single structure.

2. Description of the Prior Art

Projectile recovery devices are needed, particularly in the laboratory or test facility environment, for recovering test vehicles or projectiles by stopping them before they are damaged or otherwise rendered unusable.

Unlike actual at sea launches, in the laboratory these vehicles must be stopped within a reasonable distance. The rate at which the vehicle is decelerated must be on the same order of magnitude, or less than the acceleration the device experiences during launch. In fact, the peak deceleration should preferably be considerably less than the peak acceleration at launch. If deceleration levels are higher than acceleration at launch, possible damage to the vehicle cannot be ascribed directly to the launch phase and could be caused during the deceleration phase. As a result, discrepancies in collected data can arise due to the inability to ascribe them to one of these phases of the vehicle's flight path.

Elongated tubes or pipes that rely on fluid friction to slow the vehicle are known. Also, bumpers can be incorporated at the end of such pipe in case the vehicle does not stop in time. Another method of stopping vehicles is to provide a pipe of varying diameter along the path of travel of the vehicle. However, the pipe diameter profile is typically sized so as to achieve a predetermined velocity profile and deceleration through a known length of the pipe. The diameter profile is directly dictated by the distance within which the particular vehicle must be decelerated.

Vehicle recovery systems of this general type are shown in U.S. Pat. Nos. 3,940,981, 4,002,064 and 5,125,343.

The most recent of these, U.S. Pat. No. 5,125,343 relates to a projectile recovery system using an elongated pipe such that the projectile acts as a piston moving downstream in the water filled pipe. Ports are provided for radially releasing some of the fluid from the pipe, while fluid friction from the clearance provided between the pipe and the projectile acts upon the projectile to decelerate it. In the '064 patent, rifling is provided in the pipe to achieve substantially the same result as that provided for in the '343 patent. The '981 patent teaches the use of quick opening valves which alter the pressure in the pipe at different stations located in the axial direction of travel of the projectile.

The principal object of the present invention is to provide a single structure that is adapted to accommodate projectile type vehicles of different sizes and weights. The above mentioned prior art devices are intended to handle projectiles of only a predetermined size, diameter and weight.

SUMMARY OF THE INVENTION

Accordingly, the general purpose and object of the present invention is to provide a projectile recovery structure which will accommodate projectiles of different weight, and also of different physical size.

This object of the invention is achieved with the structure disclosed by providing an elastomeric membrane that is so supported in a surrounding vessel that its geometry can be varied by fluid pressure to accommodate projectiles of different weight and size.

The structure disclosed comprises an elongated vessel having an upstream, or projectile receiving front end, that is of considerably larger cross section than that of the projectiles to be recovered. The vessel can be generally cylindrical in shape and is adapted to be pressurized with a fluid such as water from a port provided in a sidewall thereof. An elongated elastomeric membrane of initial undeformed frustoconical shape is mounted in the elongated vessel so that its larger circular end is secured to the projectile receiving front end of the vessel. A downstream station is defined by the vessel opposite the projectile receiving front end of the vessel and is adapted to support the smaller circular end of the frustoconical elastomeric membrane. The exterior of the membrane and the interior of the vessel define a space that can be pressurized by a fluid to define a predetermined geometric configuration for the membrane's interior. The membrane will always be annular in configuration, but the inside diameter is a function of the fluid pressure, the resilience of the membrane, and the distance downstream from the membrane's front end. Thus, the diameter at a particular station depends upon the pressure introduced to the aforementioned space between the vessel and the membrane. It will be apparent that as the internal volume defined by the stressed membrane is varied between the maximum, and unpressurized condition, to a smaller volume the size or diameter of a projectile to be recovered can be varied. A further refinement to the elastomeric membrane is the provision for varying the thickness of the membrane as a function of the axial distance downstream from the front end thereof to the downstream station where the smaller end of the membrane is secured.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
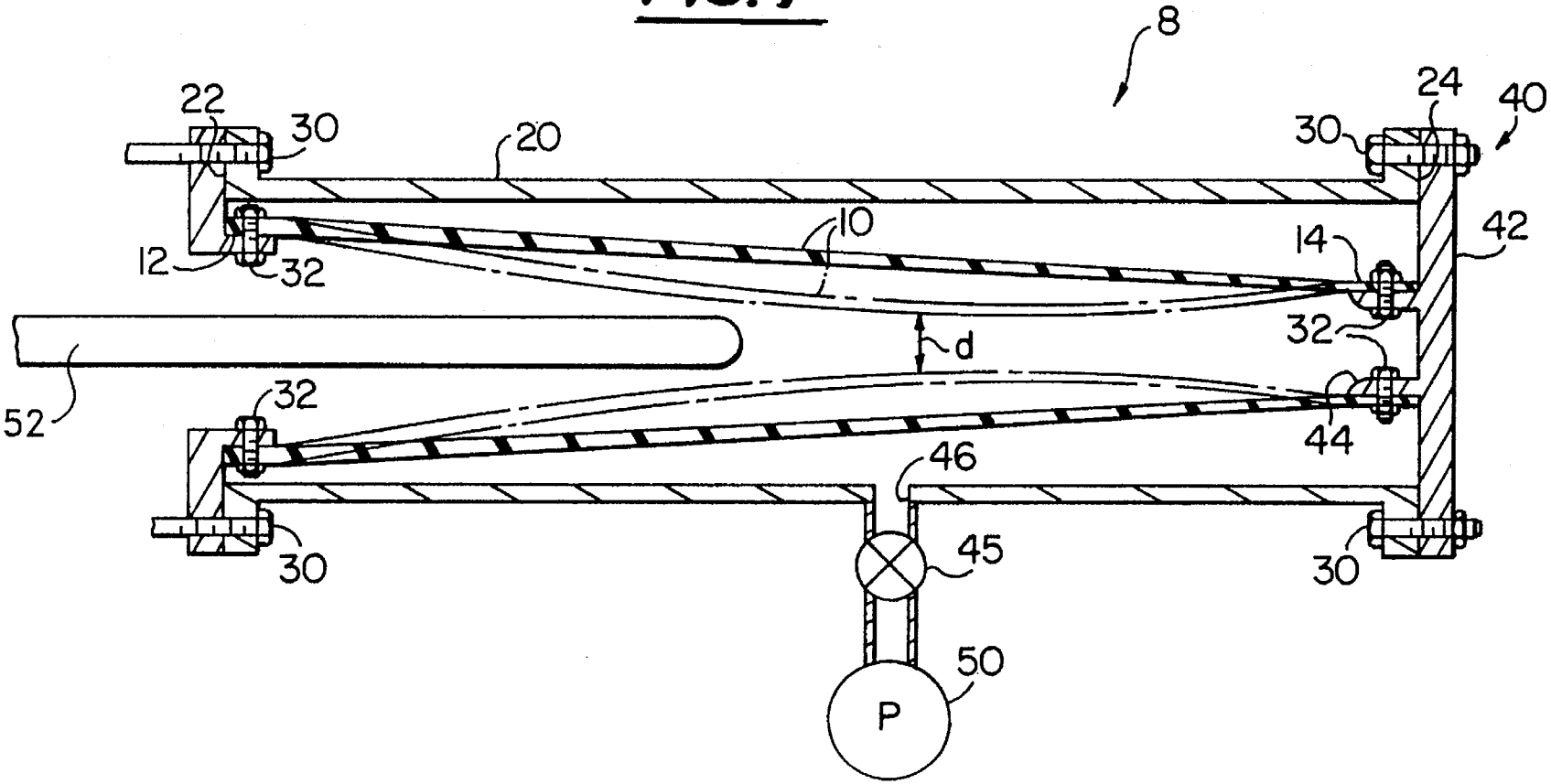
FIG. 1 is a vertical cross section illustrating a structure of the present invention with a projectile entering the front end, and with the elastomeric membrane depicted in its unstressed or initial condition in solid lines, and in a resiliently deformed position in broken lines.

Referring now to FIG. 1 there is shown an elastomeric dashpot 8 of the current invention. A generally frustoconically shaped elastomeric membrane 10 is shown in a neutral position or initial position in solid lines. Membrane 10 has an upstream end 12 and a downstream end 14 secured in a generally hollow cylindrically shaped vessel 20. The vessel 20 has a flange 22 at its upstream end which is adapted to be secured to suitable surrounding structure by additional fasteners 30. The upstream end 12 of membrane 10 is secured to flange 22 by fasteners 32. The vessel 20 has a downstream station indicated generally at 40 which defines a bulkhead 42 that is secured by a flange 24 defined for this purpose by the vessel 20 by fasteners 30.

The bulkhead 42 includes a boss 44 of generally cylindrical configuration to receive the smaller downstream end 14 of the frusto-conicial elastomeric membrane 10. Fasteners 32 are provided to secure the membrane 10 to the boss 44. The elastomeric membrane 10, at least in its undeformed or initial neutral configuration has a generally frustoconical shape. Although a cylindrical shape may also be used, (of varying cross section thickness).

A source of hydraulic pressure 50 is provided to deliver fluid under pressure through a port 46 in the sidewall of the vessel 20 to allow pressurizing the space defined between the interior of the vessel 20 and the exterior of the elastomeric membrane 10. Once pressurized, this space is preferably isolated by closing a valve 45 in or adjacent to the port 46. As the fluid pressure is increased the shape of the frustoconical membrane 10 will change from that shown in solid lines to ultimately reach a desired shape as indicated generally by the broken lines in FIG. 1. At a predetermined pressure, dictated by the structural yield strength of the elastomeric membrane, a predetermined inside diameter d of the membrane will be achieved at a station along the vessel 20 that is intermediate the upstream end of the vessel and the downstream end thereof. This minimum diameter d will be chosen so as to accommodate a cylindrical projectile 52 of predetermined diameter. It will be apparent that the thickness of the elastomeric membrane can, of course, be varied to shift this minimum diameter within a range of axial stations along the vessel 20. In some situations the minimum diameter could be at the downstream end 14 of the vessel 20.

The larger diameter upstream end of the membrane is preferably at least approximately three times the diameter of the downstream end when the membrane is in its unstressed neutral frustoconical configuration. It will also be apparent then as fluid is introduced into the space between the vessel and the membrane the internal volume defined by the membrane will be reduced from an initial value $V_0$ to a lesser value that is a function of the pressure itself and a function also of the elastomeric yield strength of the material from which the membrane is fabricated.

Obviously many modifications and variations of the present invention will become apparent in light of the above teachings. For example: the space defined between the vessel and the elastomeric membrane may be divided up into several axially adjacent subspaces, with the membrane or membrane segments secured to intermediate stations provided between the front end of the vessel 20 and the bulkhead 42 at the downstream station depicted at 40. In such case the pressure provided in these subspaces of the vessel could be pressurized to different pressures in order to provide a greater degree of control over the internal shape of the membrane itself and therefor give greater latitude to the point at which the minimum internal diameter of the membrane in the pressurized state is located. As mentioned previously, the elastomeric membrane itself may be provided with different thickness along its length to further enhance the ability to vary the actual physical shape and internal volume defined by the membrane or membranes. Still other variations in the disclosed invention are apparent. Bubbles may be used to inhibit or prevent internal fluid flow. The membrane may also be made with a substantially constant inside diameter, and fluid pressure alone relied upon to achieve the desired initial membrane shapes. Variations in membrane thickness and hence membrane stiffeners, might also be used to achieve a desired deceleration profile for a particular projectile weight and size.

In light of the above, it is therefore understood that within the scope of the appended claims, the invention may be practiced otherwise than as specifically described.

What is claimed is:

1. A projectile recovery device for decelerating a generally cylindrical projectile, said device comprising:

an elongated vessel having a projectile receiving front end portion of larger cross section than that of said projectile to be recovered, and a downstream station opposite said projectile receiving end; and an elastomeric membrane of frustoconical initial shape mounted in said elongated vessel, said membrane having a larger diameter end sealed to said elongated vessel projectile receiving front end portion, and said membrane having a smaller diameter circular end sealed to said elongated vessel downstream station, said membrane defining a projectile receiving inner volume, and said elongated elastomeric membrane and said vessel defining an intermediate space therebetween.

2. The device of claim 1 further comprising:

a fluid disposed in said intermediate space; and a fluid control means for pressurizing said fluid whereby said elastomeric membrane is altered reducing said projectile receiving inner volume.

3. The device of claim 2 wherein said fluid control means comprises:

a conduit joined to said elongated vessel, said elongated vessel having an aperture therein and said conduit being joined thereto;

a valve joined to said conduit for controlling the flow of said fluid through said conduit; and a pump joined to said valve for pressurizing said fluid.

4. The device of claim 3 wherein said pump pressurizes said fluid in said intermediate space via said conduit, said fluid deforming said elastomeric membrane to reduce said projectile receiving inner volume.

5. The device of claim 4 wherein said elastomeric membrane is deformed a greater amount at said smaller diameter circular end.

6. The device of claim 2 wherein said fluid control means provides said fluid in said intermediate space, said fluid deforming said elastomeric membrane to reduce said projectile receiving inner volume.

7. The device of claim 6 wherein said elastomeric membrane is deformed a greater amount at said smaller diameter circular end.

8. The device of claim 2 wherein said fluid is a liquid.

9. The device of claim 2 wherein said fluid is a gas.

* * * * *